US006645312B2

(12) United States Patent
Narayanaswamy

(10) Patent No.: US 6,645,312 B2
(45) Date of Patent: Nov. 11, 2003

(54) TURBULANCE AND AIR JET BUBBLED AIR INTAKE MANIFOLD WASHER

(75) Inventor: Karthikeyan R. Narayanaswamy, Canton, MI (US)

(73) Assignee: Siemens VDO Automotive Inc., Tilbury (CA)

( * ) Notice: Subject to any disclaimer, the term of this patent is extended or adjusted under 35 U.S.C. 154(b) by 110 days.

(21) Appl. No.: 09/886,645

(22) Filed: Jun. 21, 2001

(65) Prior Publication Data

US 2002/0043276 A1 Apr. 18, 2002

Related U.S. Application Data

(60) Provisional application No. 60/241,942, filed on Oct. 18, 2000.

(51) Int. Cl.[7] ..... B08B 7/04

(52) U.S. Cl. ..... 134/36; 134/34; 134/37

(58) Field of Search ..... 134/102.1, 102.2, 134/34, 36, 37

(56) References Cited

U.S. PATENT DOCUMENTS 3,884,250 A * 5/1975 Beesley ..... 134/88
5,564,447 A * 10/1996 Niedermair ..... 134/5

* cited by examiner

*Primary Examiner*—Alexander Markoff

(57) ABSTRACT

A plastic air intake manifold is cleaned by a washer. The manifold is secured in a water tight chamber and immersed in water. Impellers in the chamber create turbulence in the water to remove oil and impurities located near the impellers. Air jets are activated to produce compressed air bubbles in the water which act abrasively to further clean the manifold. The water, impurities and oil are immediately removed from the chamber by a high power suction water outlet pump.

10 Claims, 1 Drawing Sheet

TURBULANCE AND AIR JET BUBBLED AIR INTAKE MANIFOLD WASHER

This application claims priority to provisional application Ser. No. 60/241,942 filed Oct. 18, 2000.

BACKGROUND OF THE INVENTION

The present invention relates generally to an air intake manifold washer which cleans an air intake manifold immersed in a water tight chamber by creating turbulence in the water in the chamber with impellers and producing compressed air bubbles to clean and remove impurities from the air intake manifold.

An air intake manifold brings air into an internal combustion engine at the required temperature and velocity. Air intake manifolds are commonly molded through a lost core process. A core of the manifold is first formed of metal. The metal core is then over-molded with plastic and immersed in a hot lutron bath of glycolitin oil. As the metal core has a lower melting temperature than the plastic over-mold, the metal core melts, resulting in the plastic air intake manifold.

After melting the metal core, the plastic air intake manifold is cleaned to remove any dirt and impurities on the surface of the manifold. In prior cleaning methods, the plastic manifold is cleaned by a series of water jets which spray on the manifold as it travels along a conveyer belt.

There are several drawbacks to prior air intake manifold cleaners. For one, as the manifold travels down the conveyer and is sprayed with water in several stages, the washer occupies a large amount of space and water usage is not optimized. Additionally, as water jets can only be aimed at external locations of the manifold, hidden internal areas which are difficult to reach are not cleaned well or not cleaned uniformly, and a secondary manual wash operation is often needed. Finally, after the washing process is complete, the water flows off of the surface of the manifold by gravity, and any water that does not flow off of the manifold can settle on the surface, leaving impurities on the manifold.

Hence, there is a need in the art for an improved washer used for cleaning an air intake manifold.

SUMMARY OF THE INVENTION

The present invention relates generally to a washer used to clean a lost core manifold article and most preferably an air intake manifold.

A plastic air intake manifold formed by a lost core process is cleaned by the washer of the present invention. The manifold is positioned on a fixture in a water tight chamber and a chamber lid is closed. The chamber is then filled with water entering from a water inlet, completely immersing the manifold in the water. A solenoid valve controls the flow of the water through the water inlet. Impellers positioned in the chamber are turned on one at a time to create turbulence in the water to clean off oil and impurities on the surface of the manifold.

Air jets are then activated in the washer to produce air bubbles in the water. The air bubbles act abrasively on the manifold, further cleaning the manifold by removing oil and impurities remaining on the surface of the manifold. After the oil and impurities are removed from the manifold and enter the water, the water is immediately removed from the chamber through a water outlet by fast and high power suction. The water outlet is controlled by a solenoid valve. Because the water is removed quickly, the opportunity for oil impurities to adhere back to the manifold is minimized.

Accordingly, the present invention provides a washer utilized for cleaning an air intake manifold.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
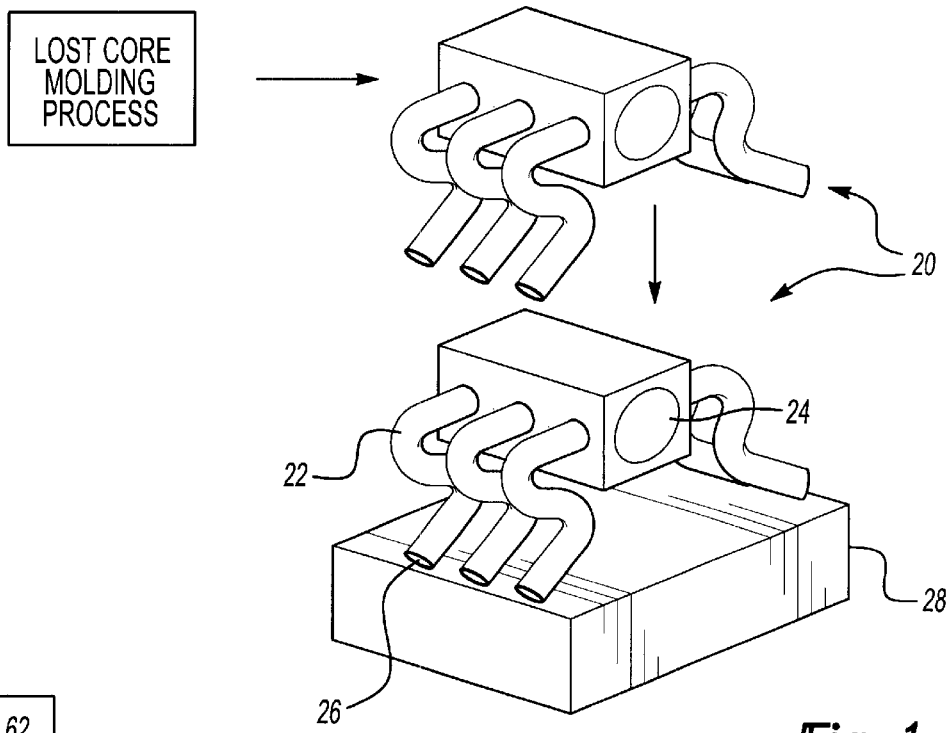
FIG. 1 illustrates a perspective view of an air intake manifold.

FIG. 1 illustrates an air intake manifold 20. An air intake manifold 20 brings air into an internal combustion engine 28 at the require temperature and velocity. Air enters the manifold 20 through inlet 24 and passes through a plurality of branched air passageways. A plurality of valves controls the flow of air into the manifold 20. Each passageways 22 includes an outlet 26 which leads to the internal combustion engine 28, shown schematically.

As known, an air intake manifold 20 is often formed by a lost core process. In the known process, a metal core is over-molded with plastic and immersed in a hot oil lutron bath. As the melting temperature of the metal core is less than the melting temperature of the plastic overmold, the metal core melts, leaving the plastic manifold 20 which is covered with oil and impurities.

Figure 2:
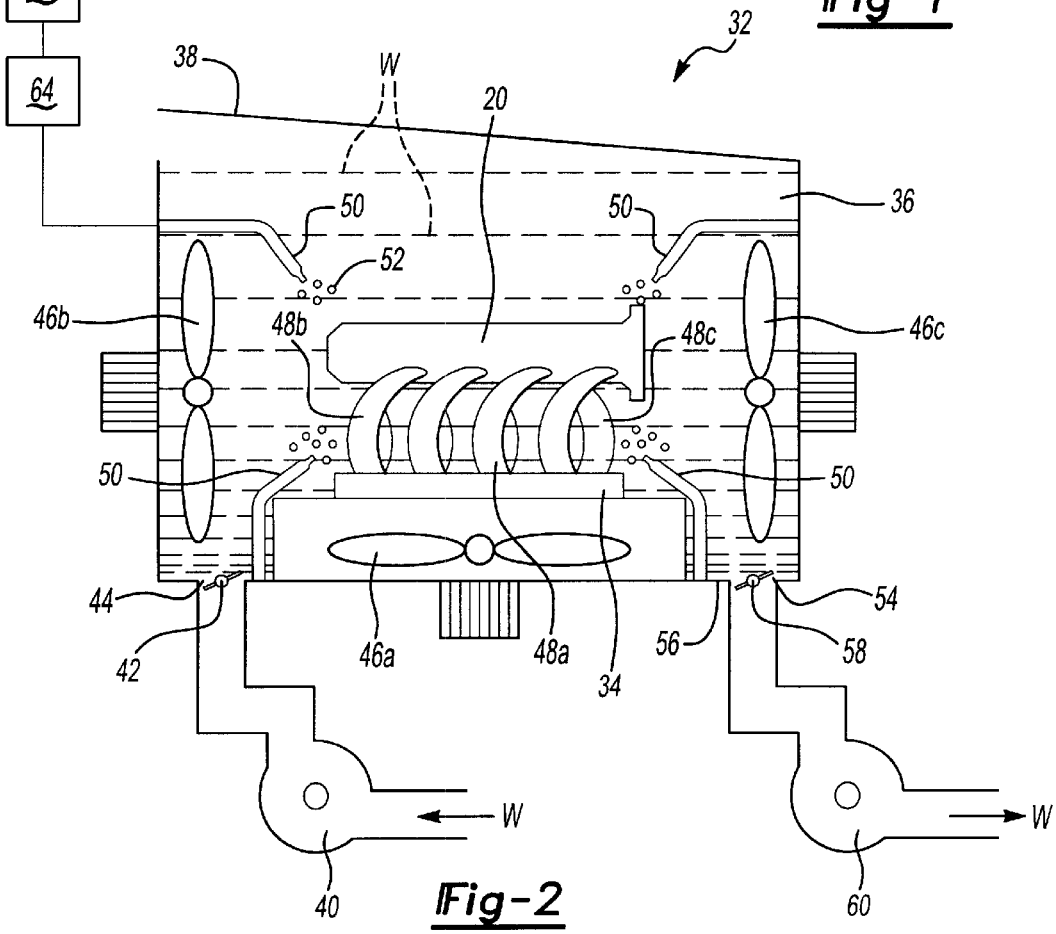
FIG. 2 illustrates the washer of the present invention used to clean the air intake manifold.

FIG. 2 illustrates the air intake manifold washer 32 of the present invention. The plastic air intake manifold 20 is securely clamped to a fixture 34 located in a chamber 36 of the washer 32. A chamber lid 38 is closed and securely clamped to the chamber 36, making the chamber 36 watertight. The chamber 36 is filled with water W which completely immerses the manifold 20. The water W enters the chamber 36 through a water inlet opening 44 by a water inlet pump 40. A valve 42 positioned proximate to the water inlet opening 44 of the chamber 36 controls the entry of the water W through the water inlet opening 44 and into the chamber 36. Valve 42 may be a solenoid controlled valve.

It is preferred that bleach be added to the water W from a bleach dispenser 62 to chemically strip the surface of the manifold 20. A bleach controller 64 controls the amount of bleach added to the water W, and a sufficient proportion of bleach is added to chemically strip the manifold 20. A worker skilled in the art would know what proportion of bleach to use to sufficiently clean the manifold 20.

Impellers 46 are positioned in the chamber 36 create turbulence in the water W in multiple directions at once to clean desired areas of the manifold 20. The impellers 46 are turned on one at a time, the turbulent water W flowing over the manifold 20 and cleaning any part exposed to the turbulent water W. In the illustrated embodiment, impeller 46*a* is turned on to stir up water W proximate to the lower portion 48*a* of the manifold 20. After impeller 46*a* is shut off, impeller 46*b* is activated to clean the left portion 48*b* of the manifold 20. Impeller 46*b* is then turned off, and impeller 46*c* is activated to clean the right portion 48*c* of the manifold 20. Although three impellers 46*a*, 46*b* and 46*c* are illustrated, it is to be understood that any number of impellers 46 can be employed. By placing impellers 46 are desired locations in the chamber 36, all areas of the manifold 20 can be cleaned. The turbulence speed of the impellers 46 can be set according to customer requirements. One skilled in the art would be able to determine the desired speed of the impellers 46.

The location of the impellers, the mounting and drive of the impellers, and the flow direction of the water from the impellers over the article would all be within a level of ordinary skill in this art. That is, dependent upon the particular part which is to be cleaned. A worker in the impeller art would know how to adequately mount and position the impellers, given the teachings of this invention.

After the impellers 46 have completed stirring up water W to remove oil and impurities from the manifold 20, air jets 50 in the washer 32 are activated to produce compressed air bubbles 52 in the water W. Although four air jets 50 are illustrated, any number of air jets 50 can be employed. The compressed air bubbles 52 act abrasively on the manifold 20, to continue removing any oil and impurities remaining on the surface of the manifold 20. Oil and impurities removed by the bubbles 52 enter the water W. The pressure of the air bubbles 52 can be set according to customer specification. One skilled in the art would be able to determined the desired pressure of the air bubbles 52.

After the air jets 40 are shut off, the water W containing the oil and impurities is immediately removed from the chamber 36 through a water outlet 54 controlled by a valve 58 positioned at the bottom 56 of the chamber 36. Valve 58 may be a solenoid controlled valve. A high and fast power water outlet pump 60 removes the water W from the chamber 36. By employing a high power water pump 60, water W, oil and impurities are immediately removed from the chamber 36 after the air jets 50 are turned off, minimizing the opportunity for any oil and impurities to adhere back to the manifold 20. After the water W is removed from the chamber 36, the manifold 20 is cleaned.

There are several advantages to utilizing the turbulence and air jet bubbled air intake manifold washer 32 of the present invention. For one, a manifold 30 can be more efficiently cleaned according to customer specifications. Additionally, hidden interior areas of the manifold 20 can be cleaned as the manifold 20 is fully immersed into the water chamber 36 and not sprayed by water jets. Additionally, as the entire washer 32 is located in the chamber 36, the space occupied by the washer 32 is substantially smaller than the space occupied by the present cleaning systems using conveyors. Water usage can also be optimized as there is more control over water usage and water volume. Also, the turbulence speed and the air bubble pressure can be controlled according to customer specifications, or can be set for the worst conditions expected, allowing for little variation in cleanliness. Labor is also reduced as a secondary cleaning operation is not necessary. Finally, after the washing operation is complete, dirt and impurities on the manifold 20 is reduced as the water W is immediately pumped out of the chamber 36.

The invention is particularly well-suited for the types of articles molded by loss core molding processes. Generally, loss core molding processes are utilized for components which will have intricate internal surfaces which are difficult to access by the prior art claiming methods.

Accordingly, the present invention provides a washer utilized for cleaning air intake manifolds.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A method for cleaning an article molded by a lost core molding process comprising the steps of:

molding an article with a lost core process;

placing said article in a chamber;

filling said chamber with water;

creating turbulence in said water in said chamber;

adding compressed air to said water to act on the article; and draining said water from said chamber.

2. The method as recited in claim 1 wherein the step of creating turbulence is provided by at least one impeller positioned in said chamber.

3. The method as recited in claim 1 further including the step of abrading said compressed air on said article.

4. The method as recited in claim 1 further comprising the step of adding bleach to said water to further clean the article.

5. The method as recited in claim 1 wherein said water fills said chamber through a water inlet.

6. The method as recited in claim 1 wherein the step of draining said water from chamber further includes activating a pump which removes said water from said chamber.

7. The method as recited in claim 6 wherein said pump employs power suction.

8. The method as recited in claim 1 further comprising the step of securing the article to a fixture in said chamber.

9. The method as recited in claim 1 wherein the step of creating turbulence in said water includes operating a first impeller at a bottom of said tank, operating a second impeller at a first side wall of said tank, and operating a third impeller at a second side wall of said tank, and said second side wall of said tank is opposite to said first side wall of said tank.

10. The method as recited in claim 1 wherein said step of creating turbulence in said water is prior to the step of adding compressed air to said water.

* * * * *